US011431141B1

(12) United States Patent
Schneider

(10) Patent No.: US 11,431,141 B1
(45) Date of Patent: Aug. 30, 2022

(54) METHOD OF MANUFACTURING A PRESS-FIT CONTACT

(71) Applicant: Interplex Industries, Inc., East Providence, RI (US)

(72) Inventor: Richard Schneider, Livonia, MI (US)

(73) Assignee: Interplex Industries, Inc., East Providence, RI (US)

( * ) Notice: Subject to any disclaimer, the term of this patent is extended or adjusted under 35 U.S.C. 154(b) by 164 days.

(21) Appl. No.: 16/984,807

(22) Filed: Aug. 4, 2020

Related U.S. Application Data

(60) Provisional application No. 62/883,318, filed on Aug. 6, 2019.

(51) Int. Cl.
*H01R 13/05* (2006.01)
*H01R 43/16* (2006.01)

(52) U.S. Cl.
CPC ..... *H01R 43/16* (2013.01); *H01R 13/05* (2013.01)

(58) Field of Classification Search
CPC ..... H01R 43/16; H01R 13/05; H01R 12/585; Y10T 29/49147; Y10T 29/49151; Y10T 29/49204
USPC ..... 29/842, 844, 874
See application file for complete search history.

(56) References Cited

U.S. PATENT DOCUMENTS

| | | | | |
|---|---|---|---|---|
| 3,634,819 | A * | 1/1972 | Evans | H01R 13/04 439/825 |
| 4,513,499 | A | 4/1985 | Roldan | |
| 4,533,204 | A | 8/1985 | Moynagh, Jr. | |
| 4,769,907 | A | 9/1988 | Sebastien | |
| 5,893,779 | A * | 4/1999 | Bianca | H01R 12/585 439/82 |
| 5,915,759 | A | 6/1999 | Logerot | |
| 6,286,209 | B1 | 9/2001 | Mitra | |
| 7,249,981 | B2 * | 7/2007 | Chen | H01R 12/585 439/751 |
| 7,891,992 | B2 | 2/2011 | Veigel | |
| 9,356,367 | B2 | 5/2016 | Vino, IV | |
| 10,153,567 | B2 | 12/2018 | Veigel | |
| 2006/0264076 | A1 * | 11/2006 | Chen | H01R 12/585 439/82 |
| 2009/0239398 | A1 * | 9/2009 | Lynch | H01R 12/585 29/855 |

FOREIGN PATENT DOCUMENTS

DE 2930560 A1 1/1981

* cited by examiner

*Primary Examiner* — Donghai D Nguyen
(74) *Attorney, Agent, or Firm* — Kattede Nupp LLC; Paul Katterle; Robert Nupp

(57) ABSTRACT

An electrically conductive contact and a method of forming the same. A precursor configuration is formed in a metal work piece. The precursor configuration has a precursor retention portion that includes a pair of precursor beams separated by a precursor slot. Forces are applied to deform the precursor configuration and thereby form a fastening section of the contact. The fastening section has a retention portion that includes a pair of finished beams separated by a finished slot. The retention portion has a different configuration than the precursor configuration.

13 Claims, 8 Drawing Sheets

METHOD OF MANUFACTURING A PRESS-FIT CONTACT

CROSS-REFERENCE TO RELATED APPLICATION(S)

This patent application claims the benefit of priority under 35 U.S.C. § 119(e) to Provisional Patent Application No. 62/883,318, filed on Aug. 6, 2019, which is incorporated herein by reference.

TECHNICAL FIELD

The present disclosure relates to an electrical contact and more particularly to an electrical contact adapted to be press-fit into a hole of a substrate, such as a printed circuit board (PCB), and a method manufacturing the same.

BACKGROUND

In electronic systems utilizing one or more PCBs, a PCB is often electrically connected to another electrical device (such as another PCB) using one or more electrical contacts that are fixed in electrically conductive hole(s) of the PCB (s). Such an electrical contact may be secured within a hole of a PCB by soldering or by a retention feature of the contact. In the latter instance, the contact is typically referred to as a press-fit contact.

Conventionally, a press-fit contact includes a compliant fastening section that plastically and elastically deforms as it is inserted into the PCB hole. This deformation creates a retention force that holds the fastening section in the PCB hole. A number of different types of construction have been used for the fastening section, one of which is known as an "eye of the needle" (EON) type of construction. In this type of construction, a slot or hole is formed in the fastening section so as to define a pair of beams that are resiliently movable toward and away from each other to provide a normal force against the PCB hole, thereby providing a reliable electrical connection.

As time progresses, electronic systems become smaller and smaller. As a result, the size of PCB holes and contacts become smaller. This reduction in size makes it more difficult to produce press-fit contacts, particularly EON press-fit contacts, that have high levels of retention force. As such, it would be desirable to provide an improved EON press-fit contact and a method of making the same that are well-suited for applications requiring small dimensions.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
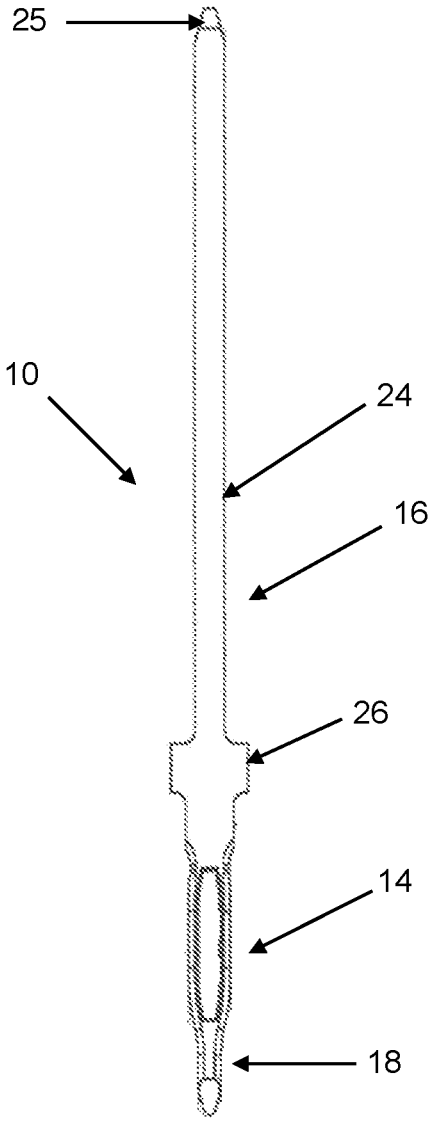
FIG. 1 shows a front elevational view of a contact embodied in accordance with the disclosure.

It should be noted that in the detailed descriptions that follow, identical components have the same reference numerals, regardless of whether they are shown in different embodiments of the present disclosure. It should also be noted that for purposes of clarity and conciseness, the drawings may not necessarily be to scale and certain features of the disclosure may be shown in somewhat schematic form.

Spatially relative terms, such as "top", "bottom", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the drawings.

Figure 2:
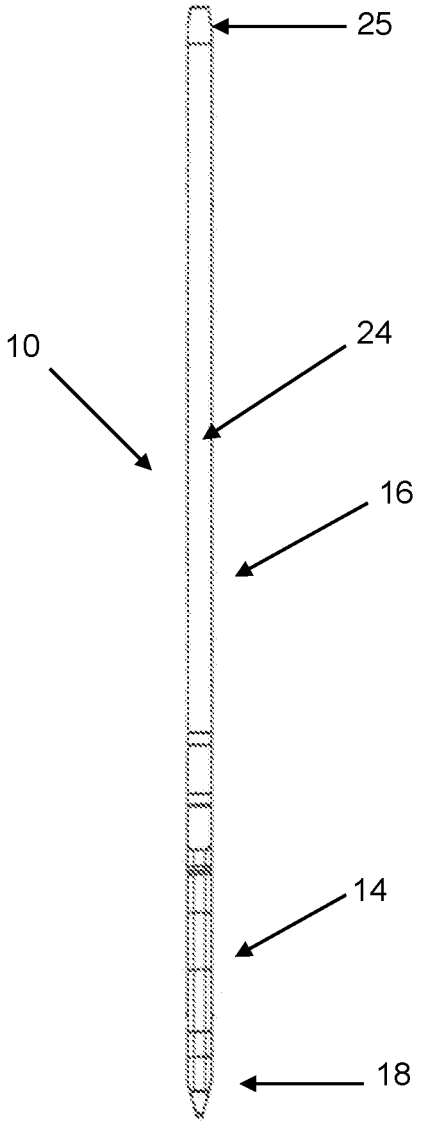
FIG. 2 shows a side elevational view of the contact of FIG. 1.

Referring now to FIGS. 1 and 2, there is shown a contact 10 constructed in accordance with this disclosure. The contact 10 has a unitary or monolithic structure and includes a fastening section 14 integrally joined to a body 16. The contact 10 is composed of a conductive metal, such as copper, a copper alloy, aluminum, or an aluminum alloy. The fastening section 14 includes a lead-in portion 18, a retention portion 20 (shown in FIG. 7) and a neck portion 22 (shown in FIG. 7), which is joined to the body 16. As will be more fully described below, the fastening section 14 is adapted for insertion into, and retention within, a plated hole in a PCB (such as PCB 72 shown in FIG. 9) so as to form a secure electrical connection therewith. The configuration of the body 16 depends on the particular application of the contact 10. As such, the body 16 may have many different configurations.

One general application for the contact 10 may be a simple pin terminal. For this general application, the contact may take the form of the embodiment shown in FIGS. 1 and 2. The body 16 may include an elongated pin 24 adapted for insertion into a female connector (not shown) so as to make an electrical connection. The pin 24 has a free end 25, distal to the fastening section 14, that is tapered to facilitate insertion. Depending on the specific application, the pin 24 may have one or more retention structures (not shown) arranged around the circumference of the pin 24. The retention structure(s) may be used to secure the pin to a connector housing or other type of component or part. A shoulder 26 may be joined to the pin 24, proximate to the fastening section 14. The shoulder 26 provides surfaces against which a force may be applied to insert the fastening section 14 into the hole of the PCB, or other substrate.

The contact 10 may be formed from a length of metal wire having a rectangular cross-section, or from metal flat stock. The size of the wire or flat stock that is used depends on the application of the contact 10. However, the structure of the contact 10 and its method of manufacture are well suited for utilizing small size wire or flat stock (e.g. a diameter or width of less than 0.5 mm) to produce small contacts 10. Although the contact 10 and its method of manufacture are well suited for this application, it should be appreciated that they can be used for other applications using larger size wire or flat stock to produce different size contacts 10. For example, wire or flat stock may be used having a width of 0.5 mm or greater, such as 0.6 mm, or 1.1 mm, or any other dimension suitable for a particular application, such as use in a PCB (such as PCB 72 shown in FIG. 9). A contact 10 for a typical PCB application with small holes will have a fastening section 14 with a width (undeformed) in a range of from about 0.4 mm to about 0.8 mm.

Figure 3:
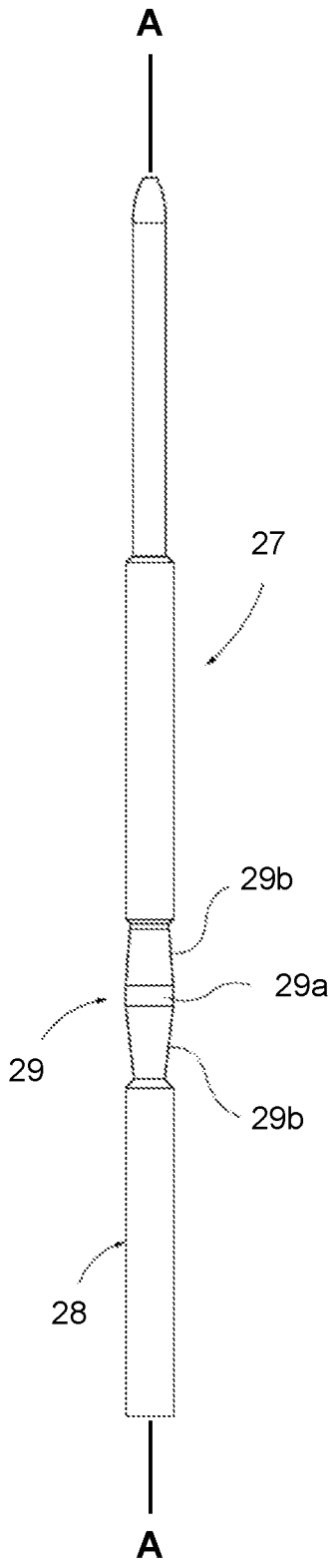
FIG. 3 shows a front elevational view of a work piece in the process of being formed into the contact of FIG. 1.

Referring now to FIG. 3, the formation of a contact pin 10 begins with a work piece 27 of wire or flat stock being cut from a source of the wire or flat stock. The work piece 27 is then mounted on a bandolier or other carrier, which carries the work piece 27 through various stages of a progressive die to produce a contact pin 10. The work piece 27 has a longitudinal axis A-A and may include a sacrificial portion 28 for connection to a carrier. In one or more pre-forming stages, a section of the work piece 27 corresponding to the fastening section 14 is formed into a precursor configuration 30 (shown in FIG. 4) that will create a desired final configuration when processed in subsequent stages.

As shown in FIG. 3, the work piece 27 may be processed in the pre-forming stages to have a barrel-shaped portion 29, with a cylindrical center section 29*a* disposed between two tapered end sections 29*b*. The barrel-shaped portion 29 may then be flattened in a pressing stage to produce an elongated, flattened ellipsoid-like shape, which is then punched to form an ellipsoid-like slot 32, thereby forming the precursor configuration 30. Of course, additional and/or different processing steps may be used to form the precursor configuration 30, depending on the starting material that is used.

Figure 4:
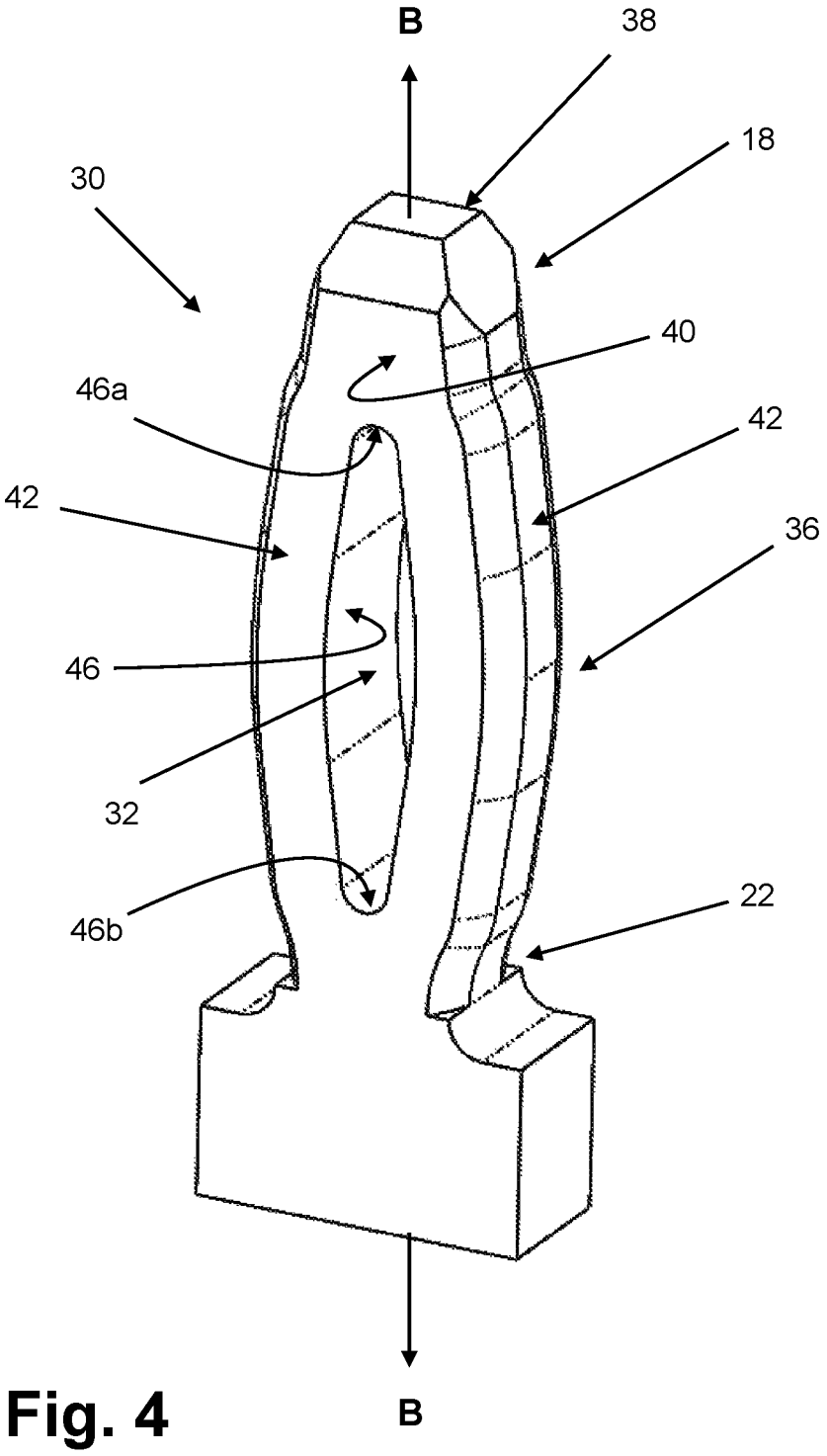
FIG. 4 shows a perspective view of a precursor configuration of a fastening section of the contact of FIG. 1.
Figure 5:
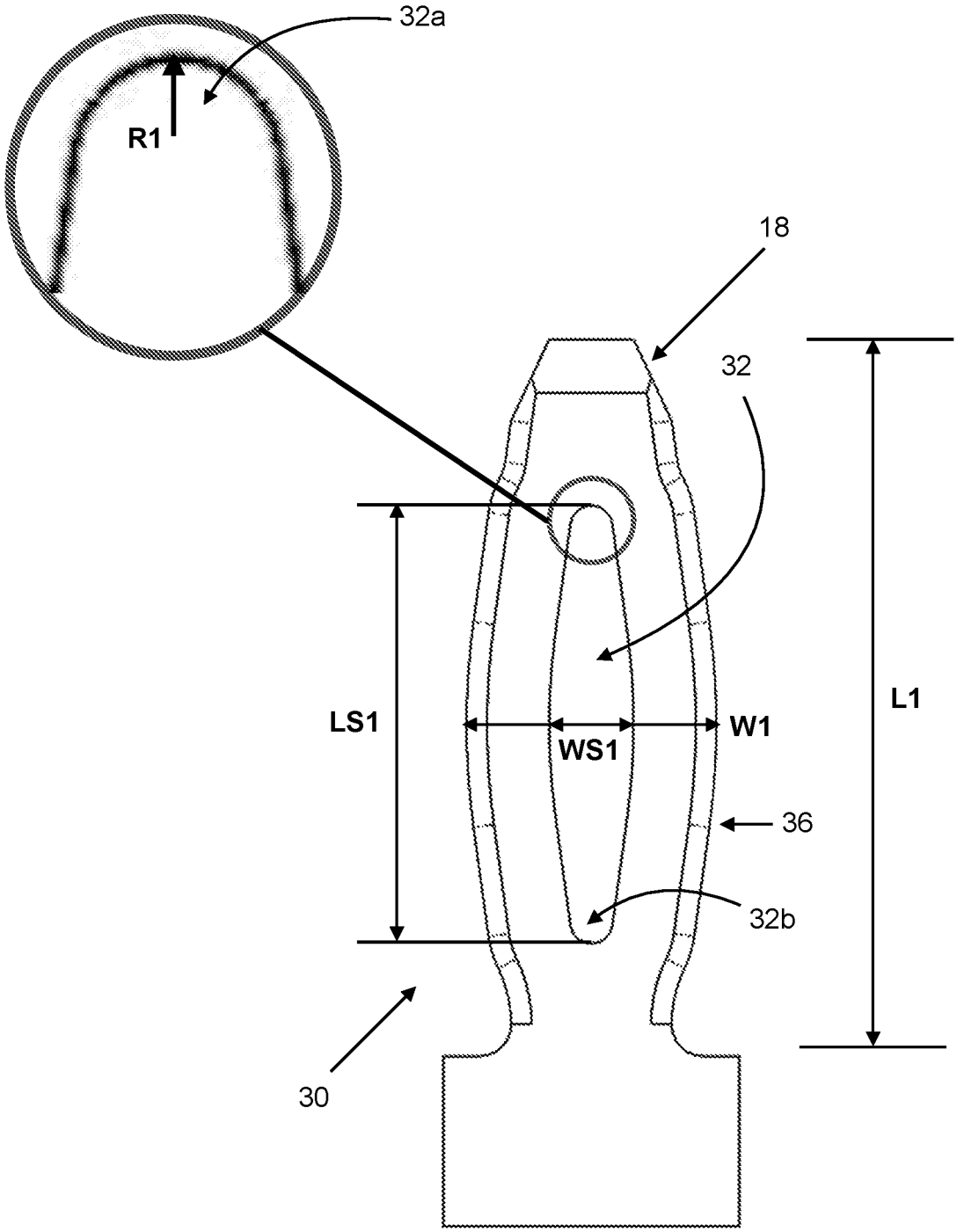
FIG. 5 shows an elevational view of the precursor configuration of FIG. 4.

Referring now to FIGS. 4 and 5, the precursor configuration 30 has a longitudinal axis B-B and a length L1. The longitudinal axis B-B corresponds to the longitudinal axis A-A of the work piece 27. The precursor configuration 30 includes the lead-in portion 18, a precursor retention portion 36 and the neck portion 22. The lead-in portion 18 includes an outer tip 38, which is solid and has opposing top and bottom surfaces and opposing side surfaces that all incline toward each other to form a tapered end. The tip 38 adjoins a top surface 40 and an opposing bottom surface (not shown), which are parallel to each other and extend in a longitudinal direction.

The top surface 40 and the bottom surface are part of the precursor retention portion 36, which will be deformed to form the retention portion 20, as described below. The slot 32 extends through the top surface 40 and the opposing bottom surface and helps form a pair of elongated beams 42. A continuous interior surface 46, defines the slot 32. The interior surface 46 has opposing end portions or junctures 46*a,b*, which are arcuate and provide the slot 32 with arcuate end portions 32*a,b*, respectively. The interior surface junctures 46*a,b* and the slot end portions 32*a,b* each have a radius of curvature R1. At its widest point, the slot 32 has a width WS1. The slot 32 also has a maximum length LS1 between the junctures 46*a,b* of the interior surface 46. In some embodiments, R1 may be from about 60 microns to about 120 microns.

The beams 42 extend in the direction of the longitudinal axis B-B of the precursor configuration 30, between the lead-in portion 18 and the neck portion 22. From the lead-in portion 18, the beams 42 curve or bow laterally outward such that in the lateral direction, the width of the precursor retention portion 36 is greater than the width of the lead-in portion 18. The bowed configuration of the beams 42 provides the precursor retention portion 36 with a maximum width W1, which coincides with the maximum width WS1 of the slot 32.

Figure 6:
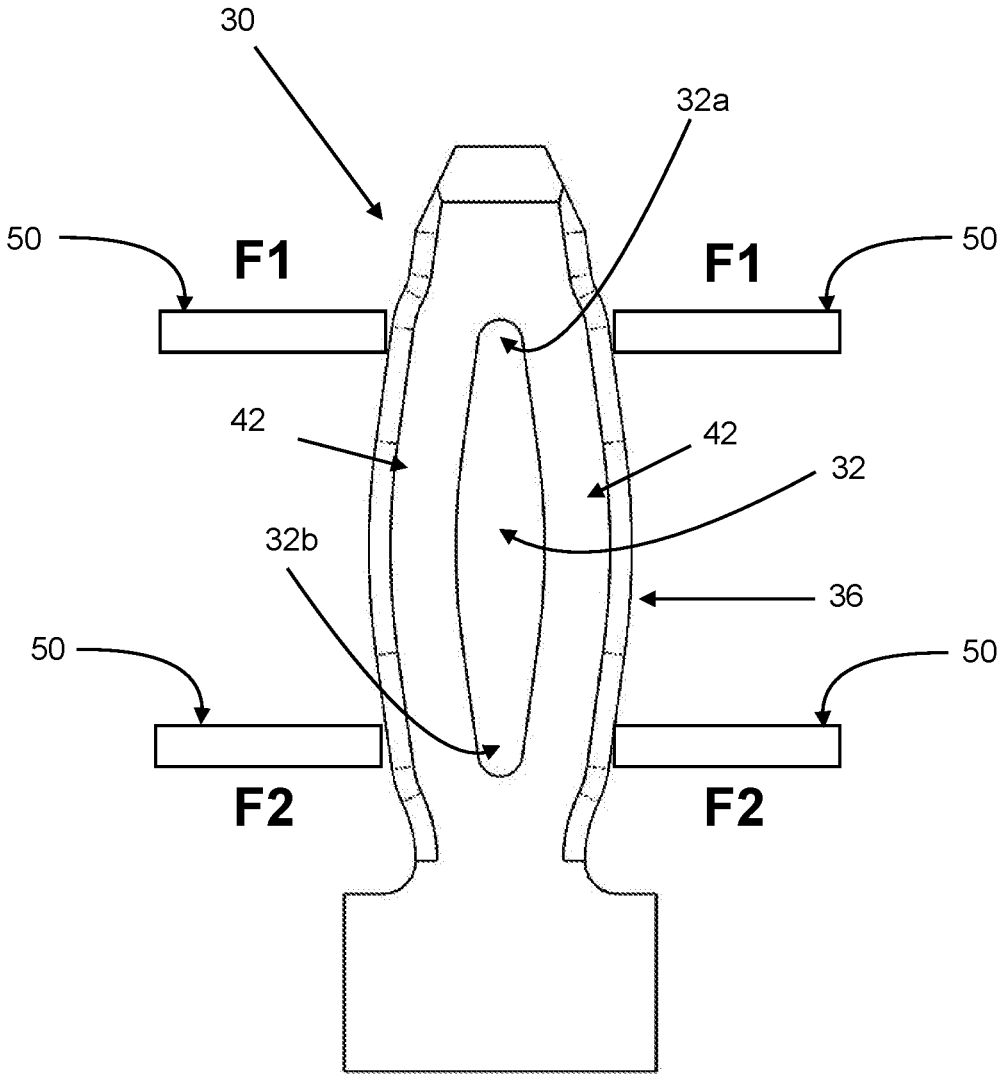
FIG. 6 shows a schematic view of the precursor configuration of FIGS. 4 and 5 being engaged by press elements for applying opposing forces to the precursor configuration.

Referring now to FIG. 6, the precursor retention portion 36 is converted into the retention portion 20 by the application of a pair of oppositely directed first forces F1 and a pair of oppositely directed second forces F2. The first forces F1 are applied to outer surfaces of the beams 42 at about the same location along the longitudinal axis B-B as the interior surface juncture 46*a*, while the second forces F2 are applied to outer surfaces of the beams 42 at about the same location along the longitudinal axis B-B as the interior surface juncture 46*b*. In other words, the beams 42 of the precursor retention portion 36 are pinched toward each other at the slot end portion 32*a* and at the slot end portion 32*b*. The pair of first forces F1 and the pair of second forces F2 may be applied at the same time or they may be applied alternately. For example, the first forces F1 may be applied initially and then, afterwards, the second forces F2 may be applied. Alternately, the second forces F2 may be applied initially and then, afterwards, the first forces F1 may be applied.

In some embodiments, the forces F1, F2 are the same and are applied to the the beams 42 of the precursor retention portion 36 in the same manner and for the same period of time so as to move the beams 42 together the same amount, i.e., to deform the precursor retention portion 36 the same at the slot end portion 32*a* as at the slot end portion 32*b*. In other embodiments, however, the forces F1, F2 may not be the same and/or may not be applied to the precursor retention portion 36 in the same manner and/or for the same period of time and, as such, the precursor retention portion 36 may not be deformed the same at the slot end portion 32*a* as it is at the slot end portion 32*b*. For example, the precursor retention portion 36 may be deformed at the slot end portion 32*a* to a greater extent than it is at the slot end portion 32*b* or vice versa.

In some embodiments, the first forces F1 may be applied by a pair of oppositely-directed press elements 50 that are moved toward each other by suitable mechanical, pneumatic or electrical actuation means. Similarly, the second forces F2 may be applied by a pair of oppositely-directed press elements 50 that are moved toward each other by suitable mechanical, pneumatic or electrical actuation means. Each press element 50 may have a contoured end surface for contacting a beam 42 of the precursor retention portion 36. The end surface of each press element 50 may have a dimension in the direction of the longitudinal axis B-B of the precursor configuration 30 that is less than ⅓, more preferably less than ¼, still more preferably less than ⅛ of the length of the LS1 of the slot 32. With this reduced dimension, the forces F1 are concentrated in the vicinity of the end portion 32*a*, while the forces F2 are concentrated in the vicinity of the end portion 32*b*. As such, forces are not applied to the beams 42 in the vicinity of the center of the slot 32 (along the longitudinal axis B-B).

In other embodiments, the forces F1 and F2 may be applied by a single pair of press elements, with only one singular press element being disposed on each side of the precursor retention portion 36. Each singular press element may have a length that is about that of LS1 and is configured to have a topography with first and second portions, wherein the first portion applies the first force F1 to the outer surface of the beam 42 at about the same location along the longitudinal axis B-B as the interior surface juncture 46*a* and the second portion applies the second force F2 to the outer surface of the beam 42 at about the same location along the longitudinal axis B-B as the interior surface juncture 46*b*. The remaining portion of each singular press element may apply force(s) to other portion(s) of the precursor retention portion 36, but any such force is substantially less than either the force F1 or the force F2 so as to not interfere with the pinching together of the beams 42 at the slot end portion 32*a* and at the slot end portion 32*b*.

The application of the first forces F1 moves the beams 42 toward each other at the slot end portion 32*a* and the application of the second forces F2 moves the beams 42 toward each other at the slot end portion 32*b*. This movement of the beams 42 narrows slot end portions 32*a,b* and, to a lesser extent, the rest of the slot 32. The application of the first and second forces F1, F2 also narrows the overall width of the precursor retention portion 36, while also extending its overall length.

The above-described deformation of the precursor retention portion 36 by the first and second forces F1, F2 transforms the precursor retention portion 36 into the retention portion 20 and transforms the precursor configuration 30 into the fastening section 14. The application of the forces F1, F2 is carefully controlled to provide the retention portion 20 with a unique configuration that has desirable functional characteristics, as described more fully below.

Figure 7:
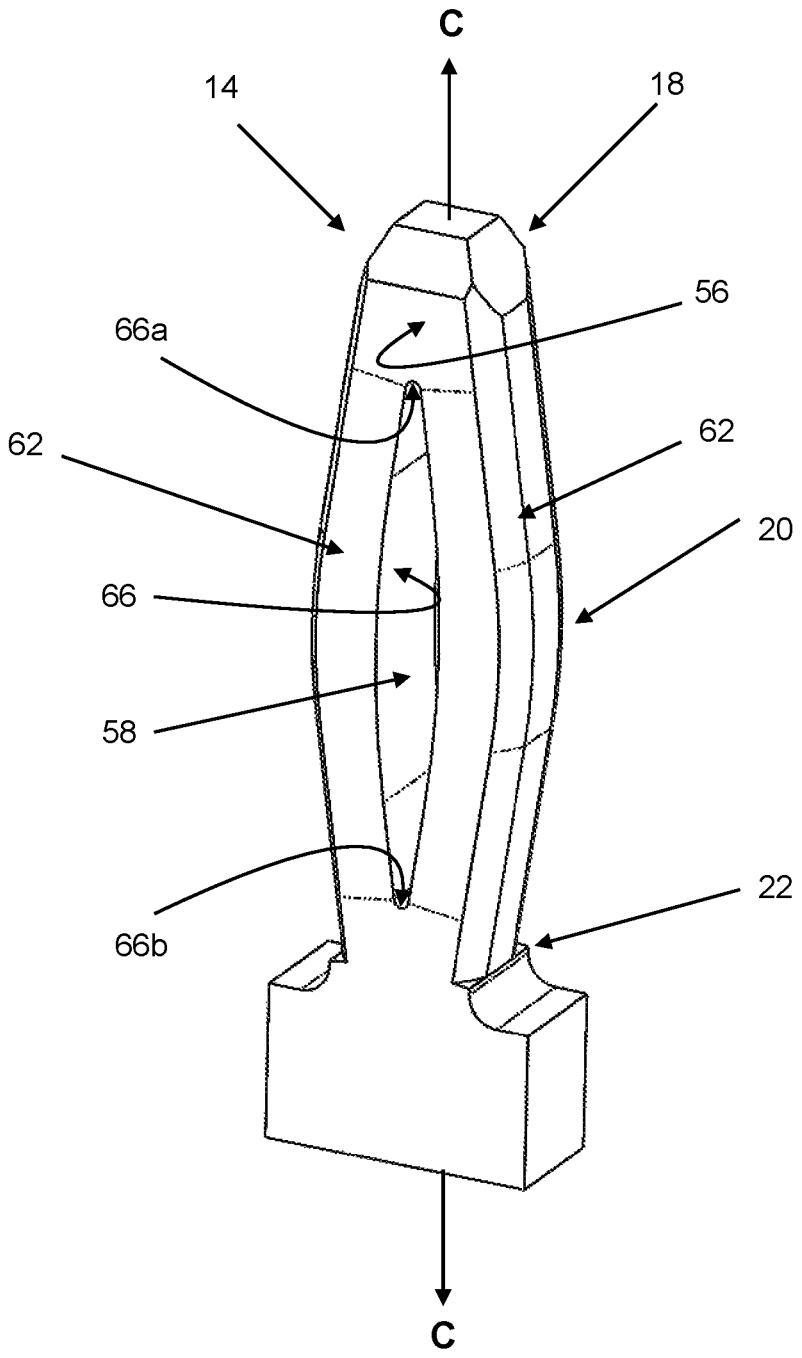
FIG. 7 shows a perspective view of the fastening section formed from the precursor configuration of FIGS. 4 and 5.
Figure 8:
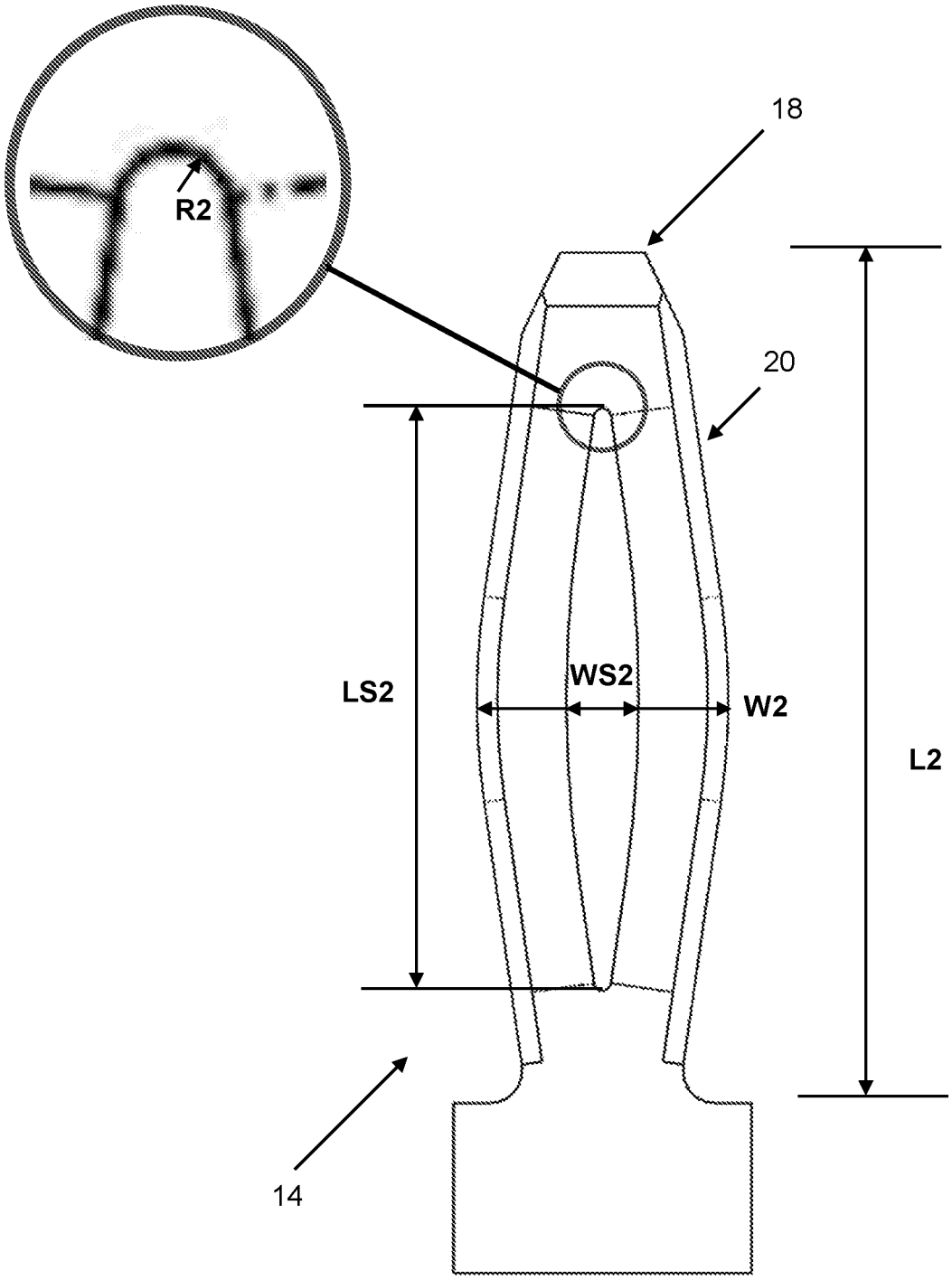
FIG. 8 shows an elevational view of the fastening section of FIG. 7.

Referring now to FIGS. 7 and 8, the fastening section 14 has a longitudinal axis C-C and includes the lead-in portion 18, the retention portion 20 and the neck portion 22. The lead-in portion 18 includes the tip 38, which is solid and tapered (as set forth above) to facilitate the insertion of the fastening section 14 into the hole of a PCB. The tip 38 adjoins a top surface 56 and an opposing bottom surface (not shown), which are parallel to each other and extend in a longitudinal direction.

The top surface 56 and the bottom surface are part of the retention portion 20, which is formed from the precursor retention portion 36. A slot 58 extends through the top surface 56 and the opposing bottom surface and helps form a pair of elongated beams 62. A continuous interior surface 66, defines the slot 58. The interior surface 66 has opposing end portions or junctures 66*a,b*, which are arcuate and provide the slot 58 with arcuate end portions 58*a,b*, respectively. The interior surface juncture 66*a* and the slot end portion 58*a* have a radius of curvature R2. In those embodiments where the precursor retention portion 36 is deformed the same at the slot end portion 32*a* as at the slot end portion 32*b*, the interior surface juncture 66*b* and the slot end portion 58*b* will also have a radius R2. At its widest point, the slot 58 has a width WS2. The slot 58 also a maximum length LS2 between the junctures 66*a,b*.

The beams 62 extend in the direction of the longitudinal axis C-C of the fastening section 14, between the lead-in portion 18 and the neck portion 22. From the lead-in portion 18, the beams 62 curve or bow laterally outward such that in the lateral direction, the width of the retention portion 20 is greater than the width of the lead-in portion 18. The bowed configuration of the beams 62 provides the retention portion 20 with a maximum width W2, which coincides with the maximum width WS2 of the slot 58.

As can best be seen in FIG. 8, the fastening section 14 has a streamlined configuration, wherein the retention portion 20 slopes outward from the lead-in portion 18 until it reaches its maximum width W2 and then slopes inward as it extends to the neck portion 22. The interior surface 66 (and thus the slot 58) also has a streamlined configuration. From the juncture 66*a*, opposing sides of the interior surface 66 (forming inner parts of the beams 42, respectively) slope or gently curve outward, away from each other, in a divergent manner, until the point where the slot 58 has its maximum width WS2. After this point, the opposing sides of the interior surface 66 slope or gently curve inward, toward each other, in a converging manner, until they reach the juncture 66*b*. In this regard, the width of the slot 58 along the longitudinal axis C-C continually increases from the end portion 58*a* until the maximum width WS2 is reached at about the center of the slot 58 (along the longitudinal axis C-C) and then continually decreases until the end portion 58*b* is reached. The shape defined by the interior surface 66 (i.e., the slot 58) approximates that of a narrow ellipse, having a minor axis with length WS2 and a major axis with length LS2, with the ratio of the major axis to the minor axis being LS2/WS2. However, the slot 58 is not an ellipse in the mathematical sense. The ratio LS2/WS2 is greater than 5 and is preferably in a range of from about 6 to about 10. In at least one embodiment, the ratio LS2/WS2 is about 8.

The amount of deformation or reconfiguration that occurs in the transformation of the precursor configuration 30 into the fastening section 14 through the application of the forces F1, F2 is illustrated by a comparison of their metrics. Overall, the fastening section 14 is at least 5% longer than the precursor configuration 30, with the length L2 of the fastening section 14 being from about 5% to about 20% longer than the length L1 of the precursor configuration 30. The fastening section 14, however, is narrower than the precursor configuration 30, with the maximum width W2 of the retention portion 20 being from about 5% to about 20% narrower than the maximum width W1 of the precursor retention portion 36. The slot 58 of the retention portion 20 is also longer and narrower than the slot 32 of the precursor retention portion 36. The maximum length LS2 of the slot 58 is at least 5% longer than the length LS1 of the slot 32. More particularly, the maximum length LS2 of the slot 58 is from about 5% to about 20% longer than the length LS1 of the slot 32, and the maximum width WS2 of the slot 58 is from about 5% to about 20% narrower than the maximum width WS1 of the slot 32.

The greatest difference between the fastening section 14 and the precursor configuration 30 is with regard to the end portions of their respective slots. The radius of curvature R2 of the slot end portions 58*a,b* (and junctures 66*a,b*) is from about 20% to more than 150% less than the radius of curvature R1 of the slot end portions 32*a,b* (and junctures 46*a,b*). The ratio of the maximum slot width to the radius of curvature of the slot end portions is also significantly different between the slots 32, 58. The ratio WS1/R1 for the slot 32 is from about 2/1 to about 4/1, whereas the ratio WS2/R2 for the slot 58 is from about 5/1 to greater than 8/1 and may be infinite if R2 is zero (see below).

Figure 9:
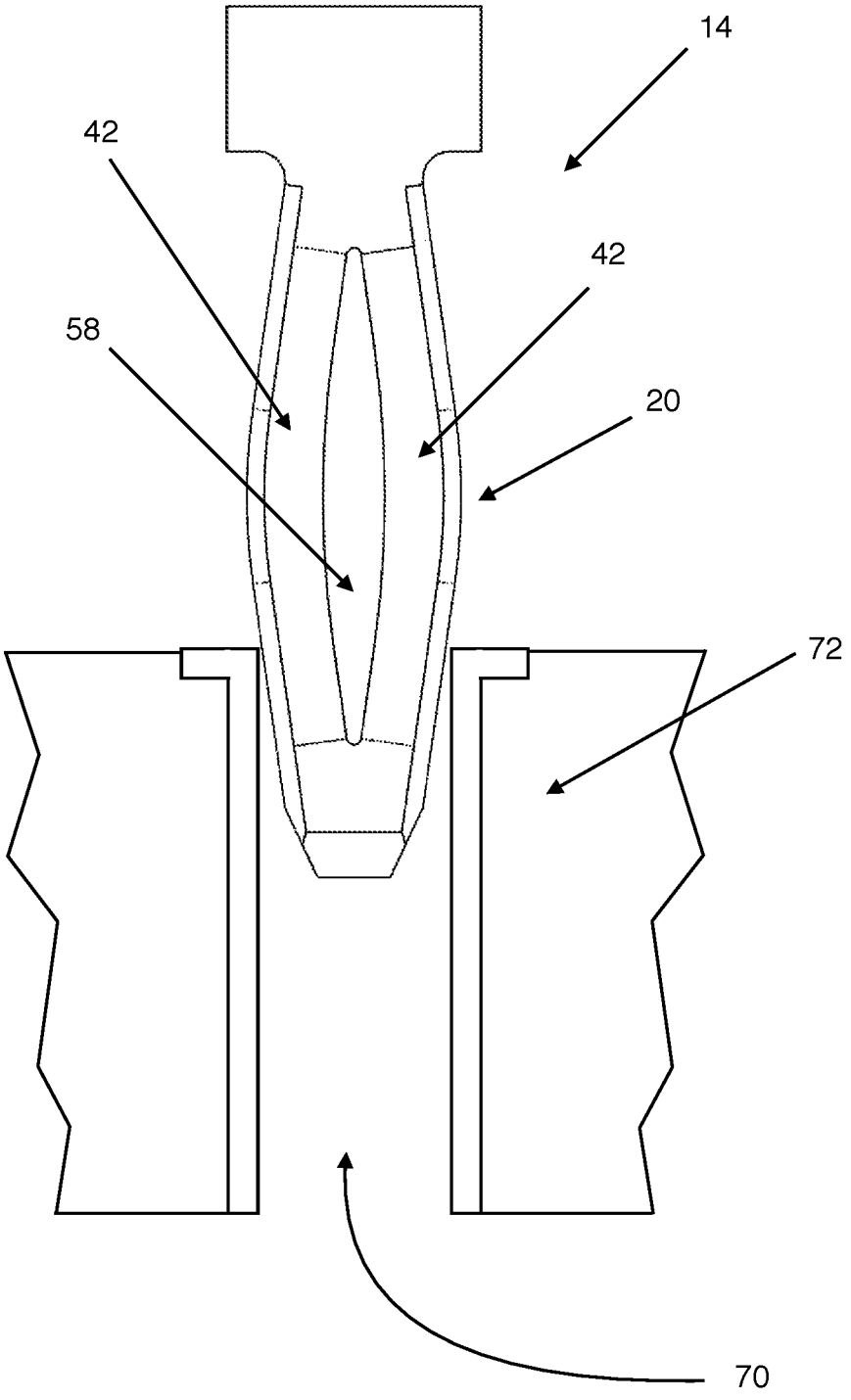
FIG. 9 shows the fastening section being inserted into a plated hole of a printed circuit board.

The manufacture and construction of the fastening section 14 described above provides the fastening section 14 with the ability to resiliently deform in the lateral direction when the fastening section 14 is being inserted into a hole 70 in a PCB 72, such as is shown in FIG. 9. More specifically, the slot 58 permits the beams 42 to resiliently move toward and away from each other in the lateral direction when laterally-inward forces are applied to the beams 40 as the fastening section 14 moves into and within the hole 70.

The pinching of the precursor retention portion 36 (application of the forces F1, F2) permits the slot end portions 58*a,b* to be made very small, i.e., to have a very small radius of curvature R2. In some embodiments, R2 may be smaller than 50 microns, which cannot be achieved by conventional blanking or piercing. Indeed, R2 may approach or be zero, i.e., the beams 42 touch each other. The achievement of such small slot end portions 58*a,b* permits very small contacts to have a desirable deformation profile in their longitudinal direction. In this regard, the retention portion 20 has a deformation profile in the direction of the longitudinal axis C-C in which the amount of (lateral) deformation of the fastening section 14 continuously increases as the retention portion 20 extends from the slot end portion 58*a* to the center of the slot 58 and then continuously decreases as the retention portion 20 extends to the slot end portion 58*b*.

At the slot end portion 58*a*, the small value of R2 permits the beams 42 to have thicker cross-sections, while avoiding a solid interference condition as the fastening section 14 of the contact 10 engages a PCB hole, such as the hole 70. The thicker cross-sections of the beams 42 maximizes the retention force acting on the fastening section 14 when it is in the hole. The avoidance of a solid interference condition prevents excessive insertion force when the fastening section 14 is inserted into the hole. Typically, the radius of curvature R2 of the slot end portion 58*a* is smaller than the radius of curvature R2' of the slot end portion 58*b*.

It should be appreciated that the deformation characteristics of the retention portion 20, including its deformation profile, can be modified or tailored to better suit a particular application or to accommodate or take advantage of a particular manufacturing process.

It is to be understood that while the foregoing descriptions are focused on contact pins for use in connecting to electrically conductive holes of PCBs, the described embodiments can be applied generally to any member that is required to be press-fit into an opening. It is to be further understood that the description of the foregoing exemplary embodiment(s) is (are) intended to be only illustrative, rather than exhaustive. Those of ordinary skill will be able to make certain additions, deletions, and/or modifications to the embodiment(s) of the disclosed subject matter without departing from the spirit of the disclosure or its scope.

What is claimed is:

1. A method of forming an electrically conductive contact that is adapted for mounting to a substrate having a hole formed therein, the method comprising:

providing a work piece of conductive metal, the work piece having a longitudinal axis;

forming a precursor configuration in the work piece, the precursor configuration including a free end portion and a precursor retention portion connected to a remaining portion of the work piece, the precursor retention portion including a pair of precursor beams separated by a precursor slot defined by a precursor interior surface having opposing side portions forming parts of the precursor beams, respectively, the side portions of the precursor interior surface being joined at opposing first and second precursor junctures, the first precursor juncture being located toward the free end portion;

forming a fastening section from the precursor configuration, the step of forming the fastening section comprising: applying a pair of first forces F1 to opposing exterior sides of the precursor beams at a location along the longitudinal axis that is aligned with the first precursor juncture, and applying a pair of second forces F2 to opposing exterior sides of the precursor beams at a location along the longitudinal axis that is aligned with the second precursor juncture;

wherein the step of forming the fastening section is performed so as to transform the precursor slot into a finished slot and transform the precursor beams into finished beams, wherein the finished slot is defined by a finished interior surface having opposing side portions forming parts of the finished beams, respectively, the side portions of the finished interior surface being joined at opposing first and second finished junctures and being bowed so as to diverge from each other as they extend away from the first and second finished junctures, respectively; and wherein the finished slot is at least 5% longer than the precursor slot in the direction of the longitudinal axis.

2. The method of claim 1, wherein the first and second precursor junctures correspond to the first and second finished junctures, respectively, the first precursor juncture being arcuate and having a radius of curvature R1 and the first finished juncture being arcuate and having a radius of curvature R2; and wherein the step of forming the fastening section is performed so that R2 is from about 20% to about 150% less than R1.

3. The method of claim 2, wherein R2 is less than 50 microns.

4. The method of claim 2, wherein the finished slot of the fastening section has a maximum width WS2; and wherein the step of forming the fastening section is performed so that the ratio WS2/R2 is at least about 5/1.

5. The method of claim 2, wherein the second finished juncture is arcuate and has a radius of curvature R2'; and wherein the step of forming the fastening section is performed so that R2 is less than R2'.

6. The method of claim 1, wherein the conductive metal is selected from the group consisting of copper, a copper alloy, aluminum and an aluminum alloy.

7. The method of claim 1, wherein the step of forming the precursor configuration comprises forming a barrel-shaped portion in the work piece.

8. The method of claim 7, wherein the step of forming the precursor configuration further comprises flattening the barrel-shaped portion to form a flattened ellipsoid-like portion and then punching a slot in the flattened ellipsoid-like portion, thereby forming the precursor retention portion and the precursor slot.

9. The method of claim 8, wherein the work piece comprises a length of metal wire having a rectangular cross-section.

10. The method of claim 1, wherein the first forces F1 are applied by moving a pair of oppositely-directed first press elements toward each other, and the second forces F2 are applied by a moving a pair of oppositely-directed second press elements toward each other.

11. The method of claim 1, wherein the first forces F1 and the second forces F2 are applied by moving a pair of oppositely-directed singular press elements toward each other.

12. The method of claim 11, wherein each singular press element is configured to have a topography with first and second portions, wherein the first portion applies the first force F1 to the exterior side of one of the precursor beams and the second portion applies the second force F2 to the exterior side of the one of the precursor beams.

13. The method of claim 1, wherein the finished slot is from about 5% to about 20% longer than the precursor slot in the direction of the longitudinal axis.

* * * * *